US011679298B2

(12) United States Patent
Hunt

(10) Patent No.: US 11,679,298 B2
(45) Date of Patent: Jun. 20, 2023

(54) STRETCHING DEVICE

(71) Applicant: John Hunt, Nashville, TN (US)

(72) Inventor: John Hunt, Nashville, TN (US)

( * ) Notice: Subject to any disclaimer, the term of this patent is extended or adjusted under 35 U.S.C. 154(b) by 54 days.

(21) Appl. No.: 17/302,152

(22) Filed: Apr. 26, 2021

(65) Prior Publication Data

US 2021/0331032 A1 Oct. 28, 2021

Related U.S. Application Data

(60) Provisional application No. 63/014,779, filed on Apr. 24, 2020.

(51) Int. Cl.
*A63B 23/00* (2006.01)
*A63B 21/00* (2006.01)

(52) U.S. Cl.
CPC ..... *A63B 23/00* (2013.01); *A63B 21/4035* (2015.10); *A63B 2023/006* (2013.01); *A63B 2208/0204* (2013.01)

(58) Field of Classification Search
CPC ..... A63B 21/00047; A63B 21/0005; A63B 21/00054; A63B 21/00185; A63B 21/068; A63B 21/4027; A63B 21/4033; A63B 21/4034; A63B 21/4035; A63B 22/14; A63B 22/16; A63B 23/00; A63B 2023/006; A63B 26/00; A63B 26/003; A63B 71/023; A63B 2071/026; A63B 2071/027; A63B 2208/0204; A63B 2208/028
See application file for complete search history.

(56) References Cited

U.S. PATENT DOCUMENTS

| | | | | | |
|---|---|---|---|---|---|
| 118,740 | A * | 9/1871 | O'Connor | A63B 21/04 | 482/123 |
| 1,019,861 | A * | 3/1912 | Titus | A63B 23/12 | 482/123 |
| 1,623,670 | A | 4/1927 | Frankenfeld | | |
| 1,623,671 | A | 4/1927 | Frankenfeld | | |
| 2,819,081 | A * | 1/1958 | Touraine | A63B 21/0618 | 482/45 |
| 3,178,180 | A * | 4/1965 | Morgan | A63B 23/0233 | 482/145 |

(Continued)

FOREIGN PATENT DOCUMENTS

| | | | | |
|---|---|---|---|---|
| DE | 202011106757 U1 * | 1/2012 | | A63B 22/18 |
| GB | 2270636 A * | 3/1994 | | A63B 21/00047 |

(Continued)

*Primary Examiner* — Gary D Urbiel Goldner
(74) *Attorney, Agent, or Firm* — Patterson Intellectual Property Law, P.C.; Ryan D. Levy

(57) ABSTRACT

A stretching device comprising: an elongate rigid planar body extending from a first end to a second end, the body further including an upper surface and an opposing lower surface; a first handle located on the upper surface of the body towards the first end of the body; a second handle located on the upper surface of the body towards the second end of the body; a first support located on the lower surface of the body towards the first end of the body; and a second support located on the lower surface of the body towards the second end of the body. The body is spaced above a floor surface by the first support and the second support such that a user may grasp one of the sides of the body.

10 Claims, 6 Drawing Sheets

(56) References Cited

U.S. PATENT DOCUMENTS 3,857,563 A * 12/1974 Azara ..... A63B 21/0618 482/142
4,358,106 A * 11/1982 Shadford ..... A63B 21/4035 482/141
4,371,162 A 2/1983 Hartzell
4,815,732 A * 3/1989 Mahvi ..... A63B 23/0482 297/367 R
4,863,163 A 9/1989 Wehrell
4,968,028 A 11/1990 Wehrell
4,982,958 A 1/1991 Ullman
5,226,868 A * 7/1993 Montgomery ..... A63B 21/4035 482/141
5,403,256 A * 4/1995 Squires ..... A63B 15/02 482/148
5,413,543 A * 5/1995 Drago ..... A63B 23/16 482/79
5,417,636 A 5/1995 Havens
5,551,934 A 9/1996 Binette
5,645,510 A 7/1997 Wilkinson
5,842,960 A 12/1998 Yu
6,280,366 B1 * 8/2001 Hsieh ..... A63B 21/4045 482/130
6,299,569 B1 10/2001 Rich
6,634,998 B2 10/2003 Siaperas
7,431,681 B1 10/2008 St. Cyr
D590,457 S 4/2009 Mishan
7,608,025 B1 10/2009 Best
7,625,294 B1 * 12/2009 Isaac ..... A63B 69/3667 473/218
D700,792 S 3/2014 Melton
8,721,507 B2 5/2014 Blancher
9,199,110 B2 12/2015 Jones
9,259,606 B2 2/2016 Wolan
9,415,260 B2 8/2016 Islas
10,035,036 B2 7/2018 DiMartino
10,179,258 B1 1/2019 Sabbagh
10,220,236 B2 3/2019 Oltorik, Jr.
10,363,450 B2 6/2019 Chapman et al.
10,940,354 B2 * 3/2021 Oltorik Jr. ..... A63B 21/4043
11,260,262 B2 * 3/2022 Oltorik ..... A63B 21/0442
2004/0009850 A1 * 1/2004 Teff ..... A63B 22/16 482/79
2004/0014571 A1 * 1/2004 Haynes ..... A63B 26/003 482/142
2005/0148448 A1 * 7/2005 Mersch ..... A63B 21/4035 482/141
2005/0209073 A1 * 9/2005 Chen ..... A63B 23/08 482/79
2006/0199706 A1 * 9/2006 Wehrell ..... A63B 21/4007 482/92
2007/0037678 A1 2/2007 Schaefer et al.
2007/0087920 A1 4/2007 Dachraoui et al.
2007/0123402 A1 * 5/2007 Cantrell ..... A61H 1/0218 482/148
2009/0124464 A1 * 5/2009 Kastelic ..... A63B 23/0458 482/52
2009/0305854 A1 * 12/2009 Brown, Jr. ..... A63B 21/04 482/140
2010/0210430 A1 * 8/2010 Mulderrig ..... A63B 21/4017 482/141
2011/0028274 A1 * 2/2011 Chong ..... A63B 21/4035 482/141
2011/0251033 A1 10/2011 Blancher
2012/0115692 A1 5/2012 Bussen et al.
2012/0244997 A1 9/2012 Thompson
2013/0316883 A1 * 11/2013 Warren ..... A63B 21/4021 482/139
2014/0011651 A1 * 1/2014 Brown ..... A63B 22/16 482/146
2014/0018217 A1 * 1/2014 Brown ..... A63B 23/1236 482/132
2014/0031183 A1 1/2014 Blake
2014/0066262 A1 3/2014 Kennedy
2014/0100090 A1 4/2014 Lima et al.
2014/0287894 A1 9/2014 Austin
2015/0018178 A1 * 1/2015 Carbone ..... G09B 19/0038 482/146
2015/0099613 A1 * 4/2015 Munoz ..... A63B 21/16 482/139
2015/0190679 A1 * 7/2015 Carbone ..... A63B 21/00069 482/146
2015/0297967 A1 * 10/2015 Simon ..... A63B 69/0097 473/446
2016/0030800 A1 * 2/2016 McClure ..... A63B 22/16 482/146
2016/0144217 A1 5/2016 Oltorik, Jr.
2016/0303422 A1 * 10/2016 Douglass ..... A63B 23/0405
2017/0072251 A1 3/2017 Fuzell-Casey et al.
2017/0296866 A1 * 10/2017 Paquin ..... A61H 1/0274
2017/0368400 A1 12/2017 Chapman et al.
2018/0043209 A1 2/2018 Kang
2018/0326239 A1 * 11/2018 Innocenzi ..... A63B 3/00
2019/0160322 A1 * 5/2019 McCarthy ..... A63B 21/4034
2020/0179745 A1 * 6/2020 Randleman ..... A63B 21/4035
2022/0031549 A1 * 2/2022 Grbic ..... A61H 1/005

FOREIGN PATENT DOCUMENTS

GB 2354956 A * 4/2001 ..... A63B 21/00047
WO 2005023372 A2 3/2005

* cited by examiner

STRETCHING DEVICE

CROSS-REFERENCE TO RELATED APPLICATION

This application claims priority to and is a non-provisional of U.S. Provisional Patent Application Ser. No. 63/014,779 for a "Stretching Device" filed on Apr. 24, 2020, the contents of which are incorporated herein by reference in its entirety.

FIELD

This disclosure relates to the field of exercise and stretching devices. More particularly, this disclosure relates to a stretching device to aid in bending during stretching, such as during a hamstring stretch.

BACKGROUND

Stretching provides important benefits such as increased flexibility and prevention of injury. Some stretches, such as a standing hamstring stretch, require a person to bend downwards to induce a stretch in the hamstrings. Typically, a person bends downwards using the person's body weight. Although effective, there are limits to the extent to which a person may bend downwards. For example, a flexible person may reach a limit at which the person may no longer bend downwards without further assistance. Similarly, someone having less flexibility may require assistance in pulling downwards to induce a stretch.

What is needed, therefore, is a stretching device that aids in stretching, such as a standing hamstring stretch, and that also provides support for other exercises.

SUMMARY

The above and other needs are met by a stretching device that allows for various stretches to be conducted and allows for enhancement of stretching using the stretching device. In a first aspect, a stretching device includes: an elongate rigid planar body extending from a first end to a second end, the elongate rigid planar body having sides extending along a length thereof, the elongate rigid body further including an upper surface and an opposing lower surface; a first handle located on the upper surface of the elongate rigid planar body towards the first end of the elongate rigid planar body; a second handle located on the upper surface of the elongate rigid planar body towards the second end of the elongate rigid planar body; a first support located on the lower surface of the elongate rigid body towards the first end of the elongate rigid planar body; and a second support located on the lower surface of the elongate rigid body towards the second end of the elongate rigid planar body. The elongate rigid planar body is spaced above a floor surface by the first support and the second support such that a user may grasp one of the sides of the elongate rigid body.

In one embodiment, each of the first handle and second handle including a pair of handle feet located on ends of the first handle and the second handle, the pair of handle feet shaped to fit against the upper surface of the elongate rigid planar body.

In another embodiment, each of the first support and the second support is a pair of support feet located towards opposing sides of the lower surface of the elongate rigid planar body.

In yet another embodiment, each of the pair of support feet of the first support and second support is aligned with the pair of handle feet of one of the first handle and the second handle.

In one embodiment, the plurality of support feet are formed of a resiliently flexible material. In another embodiment, the stretching device further includes a plurality of fasteners extending through a portion of the first handle and second handle to the first support and second support through the elongate rigid planar body.

In yet another embodiment, a portion of the first handle and the second handle is raised above the upper surface of the elongate rigid planar body. In one embodiment, the elongate rigid planar body is spaced above the floor a distance that is greater than a thickness of a user's fingertips.

In a second aspect, a stretching device includes: an elongate rigid planar body extending from a first end to a second end, the elongate rigid planar body having sides extending along a length thereof, the elongate rigid body further including an upper surface and an opposing lower surface; a first handle located on the upper surface of the elongate rigid planar body towards the first end of the elongate rigid planar body, the first handle having a pair of handle feet located at ends of the first handle; a second handle located on the upper surface of the elongate rigid planar body towards the second end of the elongate rigid planar body, the second handle having a pair of handle feet located at ends of the second handle; a plurality of support feet located on the lower surface of the elongate rigid body towards the first end and the second end of the elongate rigid planar body, each of the plurality of support feet aligned with the pair of handle feet of the first handle and the second handle. The elongate rigid planar body is spaced above a floor surface by the first support and the second support such that a user may grasp one of the sides of the elongate rigid body.

In a third aspect, a stretching device includes: a planar body extending from a first end to a second end, the body having sides extending along a length thereof, the body further including an upper surface and an opposing lower surface; a first handle located on the upper surface of the planar body towards the first end of the planar body, the first handle having a pair of handle feet located at ends of the first handle; a second handle located on the upper surface of the planar body towards the second end of the planar body, the second handle having a pair of handle feet located at ends of the second handle; a plurality of resiliently flexible support feet located on the lower surface of the planar body towards the first end and the second end of the planar body, each of the plurality of support feet aligned with the pair of handle feet of the first handle and the second handle and secured by a fastener extending therethrough. The planar body is spaced above a floor surface by the first support and the second support such that a user may grasp one of the sides of the planar body.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

Figure 1:
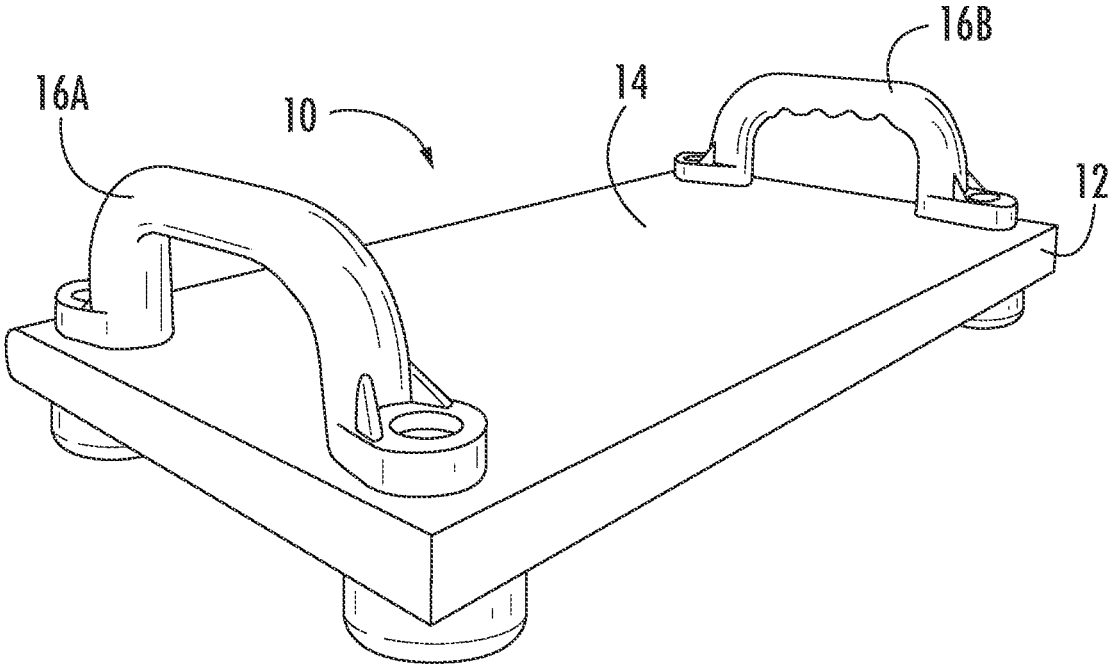
FIG. 1 shows a perspective view of a stretching device according to one embodiment of the present disclosure.
Figure 2:
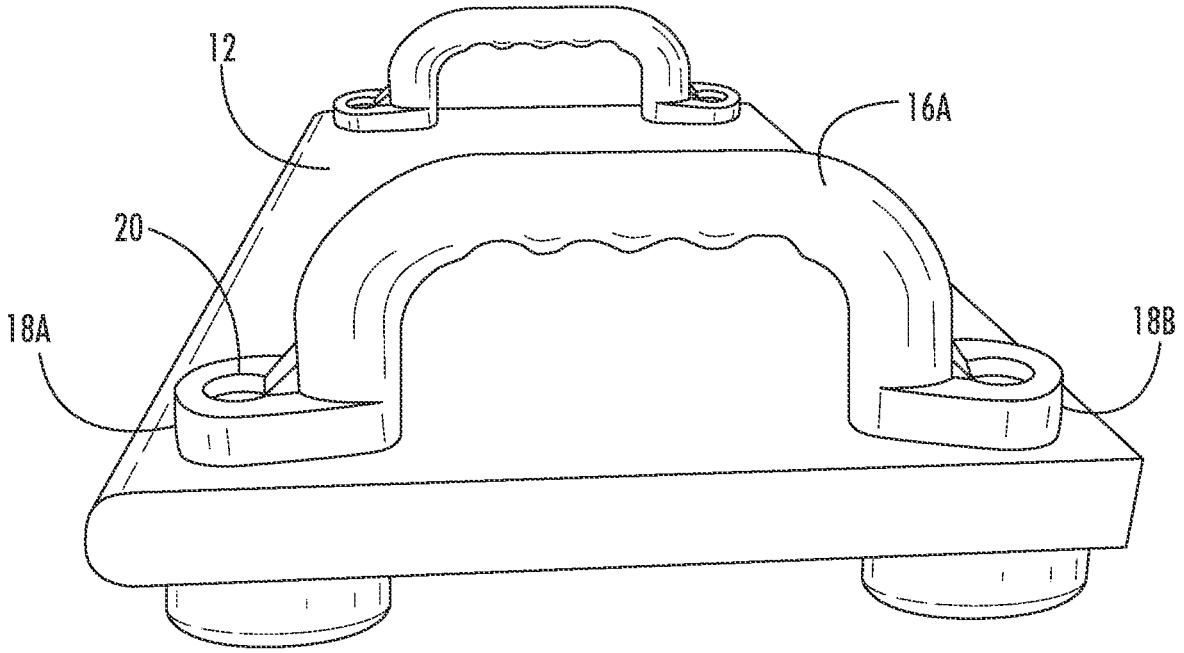
FIG. 2 shows a side view of a stretching device according to one embodiment of the present disclosure.

FIG. 1 shows an embodiment of a stretching device 10. The stretching device 10 enables a user to grasp a portion of the stretching device 10, such as during a standing hamstring stretch. Embodiments of the stretching device 10 described herein enable the user to maintain a deeper stretch than may otherwise be possible. Further, the stretching device 10 may be used for various other stretches and exercise by providing support to the user during stretches or exercises.

The stretching device includes a body 12. The body 12 is preferably planar in shape, such as a rectangle. The body 12 includes a surface 14 for supporting a user on the stretching device 10. The body 12 is preferably planar and may be formed, for example, from wood, metal, a plastic/polymer, and other suitable materials. The body 12 is preferably substantially rigid such that the body 12 may support a weight of the user as described in greater detail below without substantially flexing or otherwise bending during use.

With further reference to the figures, the stretching device 10 further includes a pair of handles 16A and 16B. The handles 16A and 16B are preferably located at opposing ends of the body 12. For example, when the body 12 is formed of an elongate plank, the handles 16A and 16B are preferably located at opposing ends of a lengthwise portion of the body 12. Each of the handles 16A and 16B preferably includes a pair of feet 18A and 18B located on opposing ends of the handles 16A and 16B. The feet 18A and 18B of the handles 16A and 16B are preferably shaped to rest against the surface 14 of the body 12. The handles 16A and 16B are preferably secured on the body 12, such as by inserting a fastener 20 through each of the feet 18A and 18B into or through the body 12. The handles 16A and 16B are preferably formed of a plastic/polymer material and include a contoured portion shaped to fit with a user's hand when the handles 16A and 16B are grasped by the user. The handles may be alternatively formed of other suitable materials or shapes such that the user may grasp the handles 16A and 16B during stretching or exercises as discussed in greater detail below.

Figure 3:
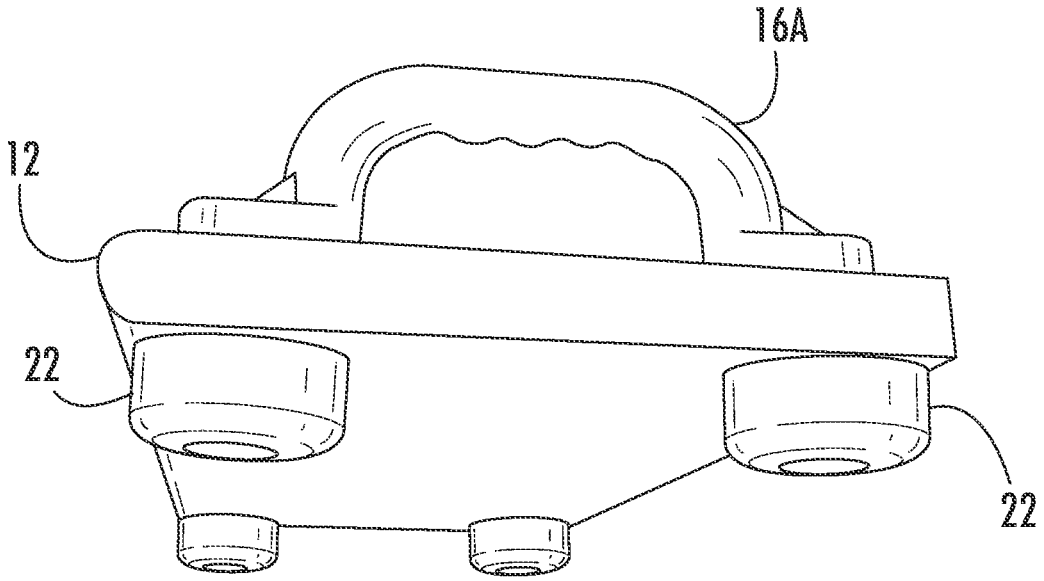
FIG. 3 shows a bottom perspective view of a stretching device according to one embodiment of the present disclosure.

Referring to FIG. 3, the stretching device 10 further preferably includes a plurality of feet 22 located on a bottom of the body 12. The plurality of feet 22 are preferably located at ends of the body 12 such that the feet 22 provide stable support for the body 12 and maintain the body 12 above a floor surface. For example, when the body 12 is formed as an elongate rectangular plank, the plurality of feet 22 are preferably located at corners of an underside of the body 12 as shown in FIG. 3. The plurality of feet 22 are preferably formed of a resiliently flexible material, such as a rubber or plastic/polymer material. The plurality of feet 22 have a height such that the plurality of feet 22 support the body 12 above a floor surface. A height of the feet 22 is preferably such that a gap exists between an underside of the body 12 and the floor surface. The gap is preferably large enough such that a portion of a user's hand, such as the user's finger tips, may fit between the underside of the body 12 and the floor surface on which the stretching device 10 rests when the user is standing on the stretching device 10, thereby enabling the user to grasp one or more edges of the body 12 during a stretch or exercise as described in greater detail below. As shown in the figures, the plurality of feet 22 may be cylindrical in shape. However, it is also understood that the feet 22 may be formed in various other suitable shapes for supporting the stretching device 10 on a surface.

Figure 8:
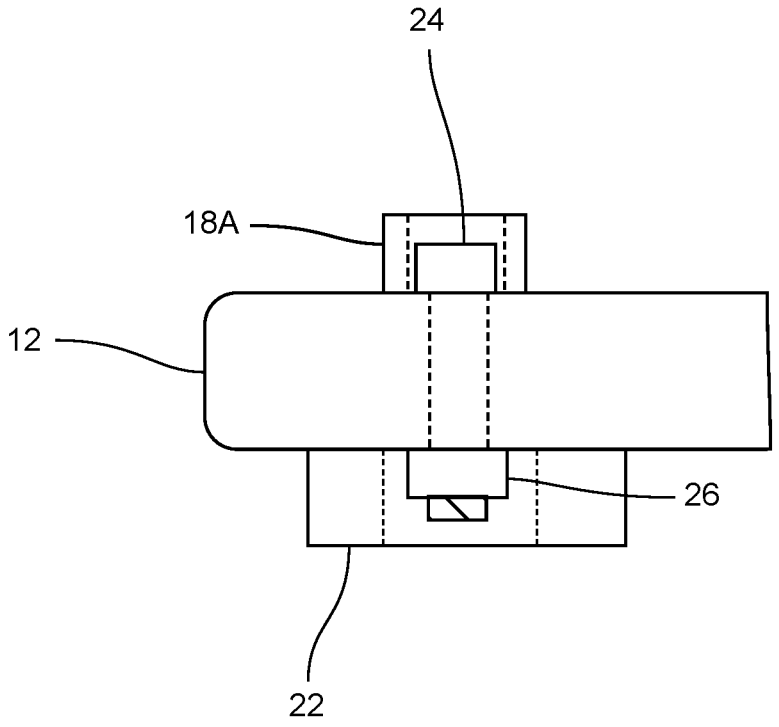
FIG. 8 shows a cross-sectional side view of a portion of a stretching device according to one embodiment of the present disclosure.

The plurality of feet 22 are preferably secured on the underside of the body as shown in FIG. 3. The plurality of feet 22 may be secured to the underside of the body with fasteners inserted through at least a portion of the feet. In one embodiment, the plurality of feet 22 are aligned with the feet 18A and 18B of the handles 16A and 16B. When each of the plurality of feet 22 is aligned with one of the feet 18A and 18B of the handles, a fastener 24 (FIG. 8) may be inserted through the feet 18A and 18B of the handles, through the body 12, and through the feet 22 such that a single fastener secures each of the feet 18A and 18B and each of the plurality of feet 22 to the body 12. The fastener 24 may be, for example, a bolt extending through the feet 18A of the handles, through the body 12, and into the foot 22 of the body 12 and includes a corresponding nut 26 securing the fastener 24 thereto.

Figure 4:
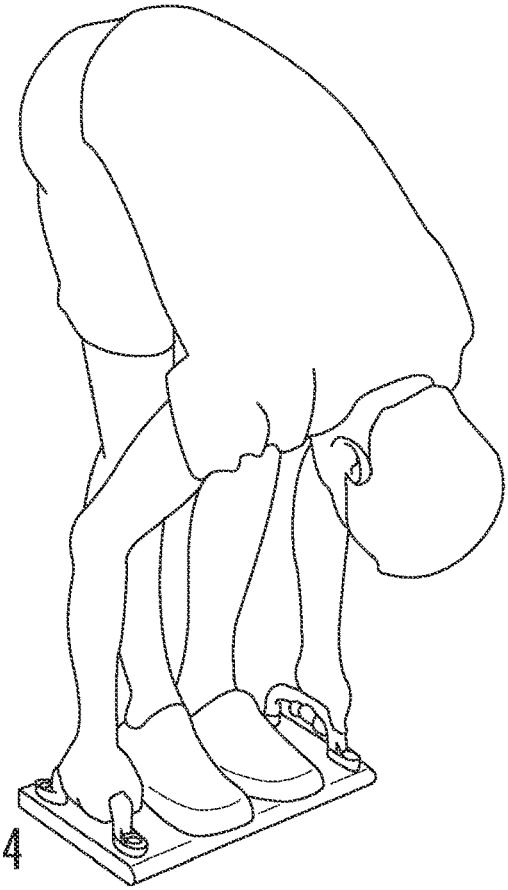
FIGS. 4-7 show stretches and exercises being performed on a stretching device according to one embodiment of the present disclosure.
Figure 5:
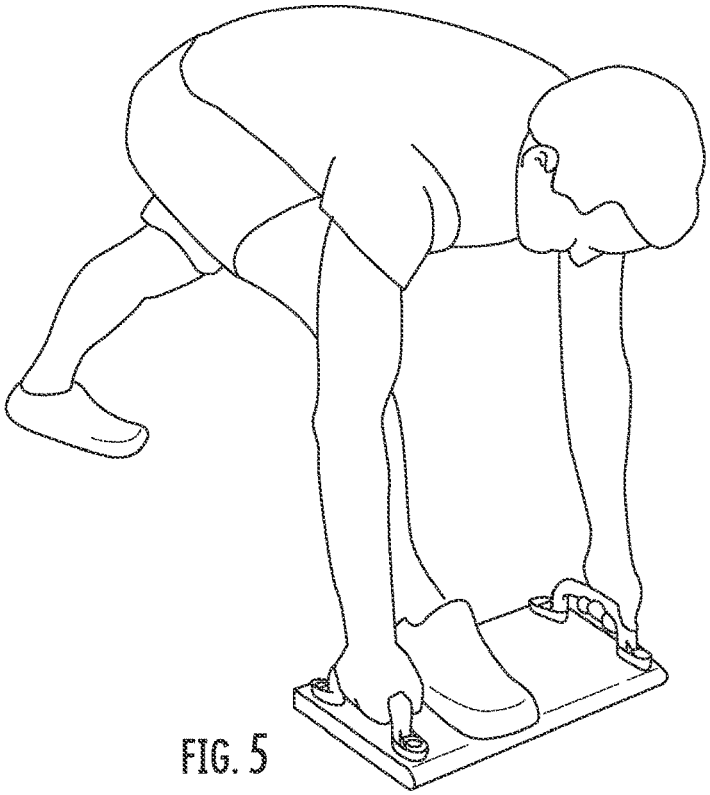
Figure 6:
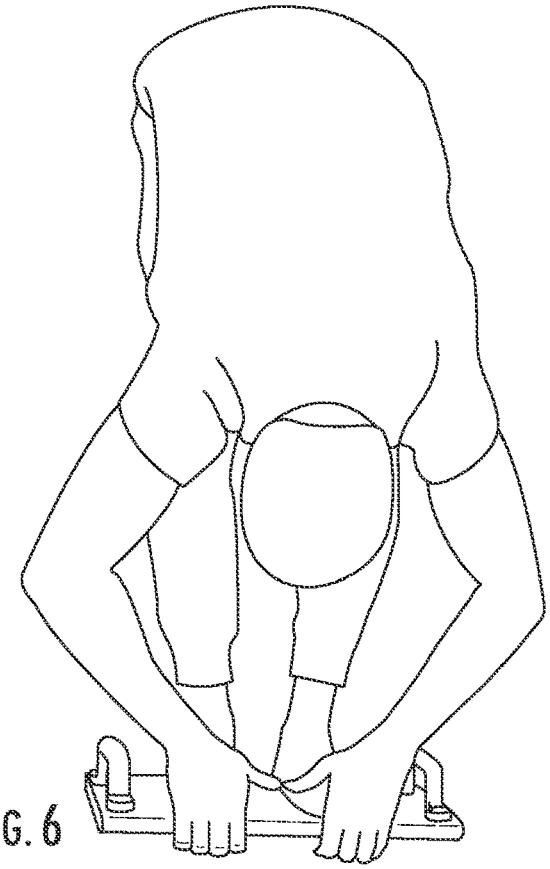
Figure 7:
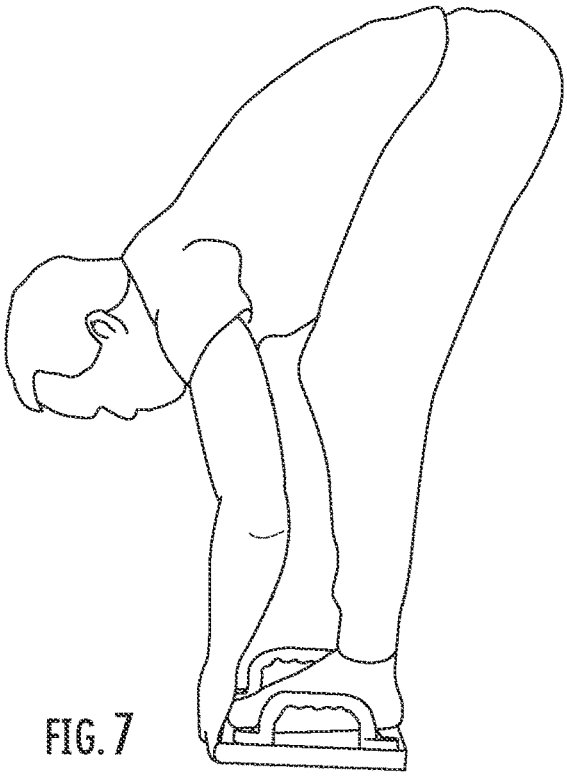

As shown in FIGS. 4 and 5, when in use, the stretching device 10 aids in allowing a user to grasp the handles 16A and 16B to pull downward during a stretch, thereby enabling a deeper stretch. Further, the handles 16A and 16B provide a location for the user to grasp during a stretch or exercise. For example, for a user with less flexibility, the raised handles 16A and 16B enable the user to grab a location above the user's feet while also allowing the user to pull downward to further stretch. Referring to FIGS. 6 and 7, the user may further grasp an edge of the body 12 such that the user's fingertips can fit between an underside of the body 12 and a floor surface.

Embodiments of the stretching device described herein advantageously enable to user to perform various stretches and exercises while providing a stable platform for the user to grab and stand on. Various stretches may be performed enabling the user to obtain a deeper stretch than may otherwise be possible or to provide stability to the user during exercises.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A stretching device comprising:

an elongate rigid planar body extending from a first end to a second end thereof, the elongate rigid planar body having sides extending along a length thereof, the elongate rigid planar body further including an upper surface and an opposing lower surface;

a first handle located on the upper surface of the elongate rigid planar body towards the first end of the elongate rigid planar body;

a second handle located on the upper surface of the elongate rigid planar body towards the second end of the elongate rigid planar body;

a first support located on the lower surface of the elongate rigid planar body towards the first end of the elongate rigid planar body; and a second support located on the lower surface of the elongate rigid planar body towards the second end of the elongate rigid planar body;

wherein the elongate rigid planar body is configured to be spaced above a floor surface by the first support and the second support for a user to grasp one of the sides of the elongate rigid planar body.

2. The stretching device of claim 1, wherein the first handle includes first ends with handle feet located at the first ends and wherein the second handle includes second ends with handle feet located at the second ends, the handle feet shaped to fit against the upper surface of the elongate rigid planar body.

3. The stretching device of claim 1, wherein each of the first support and the second support comprises a pair of support feet located towards opposing sides of the lower surface of the elongate rigid planar body.

4. The stretching device of claim 3, wherein each of the pair of support feet of the first support and the second support is respectively aligned with a pair of handle feet of a corresponding one of the first handle and the second handle.

5. The stretching device of claim 3, wherein each pair of support feet comprises a resiliently flexible material.

6. The stretching device of claim 1, further comprising a plurality of fasteners extending through a portion of the first handle and the second handle to the first support and the second support through the elongate rigid planar body.

7. The stretching device of claim 1, wherein a portion of the first handle and the second handle is raised above the upper surface of the elongate rigid planar body.

8. The stretching device of claim 1, wherein the elongate rigid planar body is configured to be spaced above the floor surface a distance that is greater than a thickness of fingertips of the user.

9. A stretching device comprising:

an elongate rigid planar body extending from a first end to a second end thereof, the elongate rigid planar body having sides extending along a length thereof, the elongate rigid planar body further including an upper surface and an opposing lower surface;

a first handle located on the upper surface of the elongate rigid planar body towards the first end of the elongate rigid planar body, the first handle having a pair of handle feet located at ends of the first handle;

a second handle located on the upper surface of the elongate rigid planar body towards the second end of the elongate rigid planar body, the second handle having a pair of handle feet located at ends of the second handle;

a plurality of support feet located on the lower surface of the elongate rigid planar body towards the first end and the second end of the elongate rigid planar body, each of the plurality of support feet respectively aligned with the pair of handle feet of the first handle and the second handle;

wherein the elongate rigid planar body is configured to be spaced above a floor surface by the plurality of support feet such that a user may grasp one of the sides of the elongate rigid planar body.

10. A stretching device comprising:

a planar body extending from a first end to a second end thereof, the planar body having sides extending along a length thereof, the planar body further including an upper surface and an opposing lower surface;

a first handle located on the upper surface of the planar body towards the first end of the planar body, the first handle having a pair of handle feet located at ends of the first handle;

a second handle located on the upper surface of the planar body towards the second end of the planar body, the second handle having a pair of handle feet located at ends of the second handle;

a plurality of resiliently flexible support feet located on the lower surface of the planar body towards the first end and the second end of the planar body, the plurality of resiliently flexible support feet respectively aligned with the pair of handle feet of the first handle and the second handle and respectively secured by a fastener extending therethrough;

wherein the planar body is spaced above a floor surface by the plurality of resiliently flexible support feet such that a user may grasp one of the sides of the planar body.

* * * * *